US005655915A

United States Patent [19]

McMills et al.

[11] Patent Number: 5,655,915

[45] Date of Patent: *Aug. 12, 1997

[54] COAXIAL CABLE CONNECTION PROTECTION SYSTEM FOR UNUSED CONNECTION PORT

[75] Inventors: Corey McMills, Los Altos; John Mattis, Sunnyvale, both of Calif.

[73] Assignee: Raychem Corporation, Menlo Park, Calif.

[ * ] Notice: The term of this patent shall not extend beyond the expiration date of Pat. No. 5,435,736.

[21] Appl. No.: 456,885

[22] Filed: Jun. 1, 1995

Related U.S. Application Data

[63] Continuation of Ser. No. 118,119, Sep. 7, 1993, Pat. No. 5,435,736.

[51] Int. Cl.[6] ..... H01R 13/44

[52] U.S. Cl. ..... 439/133; 439/578; 439/135

[58] Field of Search ..... 439/133, 135, 439/578

[56] References Cited

U.S. PATENT DOCUMENTS

| | | | |
|---|---|---|---|
| 2,805,399 | 9/1957 | Leeper | 333/6 |
| 3,196,382 | 7/1965 | Morello et al. . | |
| 3,264,602 | 8/1966 | Schwartz . | |
| 3,519,979 | 7/1970 | Bodenstein | 439/133 OR |
| 3,550,064 | 12/1970 | Caller et al. . | |
| 3,573,702 | 4/1971 | O'Keefe | 439/133 X |
| 3,633,150 | 1/1972 | Swartz . | |
| 3,697,930 | 10/1972 | Shirey . | |
| 3,710,005 | 1/1973 | French | 174/89 |
| 3,731,378 | 5/1973 | Toma et al. | 29/629 |
| 3,768,063 | 10/1973 | Coffman | 439/135 OR |
| 3,781,762 | 12/1973 | Quakenbush . | |
| 3,963,321 | 6/1976 | Burger et al. . | |
| 4,053,200 | 10/1977 | Pugner . | |
| 4,168,921 | 9/1979 | Blanschard | 403/19 |
| 4,173,385 | 11/1979 | Fenn et al. . | |
| 4,249,790 | 2/1981 | Ito et al. . | |
| 4,421,369 | 12/1983 | Myking . | |
| 4,469,386 | 9/1984 | Ackerman | 439/133 OR |
| 4,583,811 | 4/1986 | McMills . | |
| 4,660,921 | 4/1987 | Hauver | 399/177 R |
| 4,674,813 | 6/1987 | Feldner | 439/133 |
| 4,789,355 | 12/1988 | Lee | 439/584 |
| 4,806,116 | 2/1989 | Ackerman | 439/304 |
| 4,834,675 | 5/1989 | Samchisen | 439/578 |
| 4,998,894 | 3/1991 | Gronvall | 439/521 |
| 5,066,248 | 11/1991 | Gaver et al. | 439/578 |
| 5,127,853 | 7/1992 | McMills et al. | 439/578 |
| 5,435,736 | 7/1995 | McMills et al. | 439/133 |

FOREIGN PATENT DOCUMENTS

| | | |
|---|---|---|
| 0 203 263A2 | 12/1986 | European Pat. Off. . |
| 1 565 981 | 10/1966 | Germany . |
| 621459 | 4/1949 | United Kingdom . |
| 2013420 | 8/1979 | United Kingdom . |

*Primary Examiner*—David L. Pirlot
*Assistant Examiner*—Daniel Wittels
*Attorney, Agent, or Firm*—William D. Zahrt, II; Herbert G. Burkard

[57] ABSTRACT

A terminator cap and system for using the terminator cap is provided for protecting a standard coaxial cable port from atmospheric conditions and from unwarranted tampering. The cap is a hollow cylinder with one enclosed end. The terminator cap is dimensioned to slip over one end of a connection jack connector, the other end of which has a plurality of attachment fingers dimensioned to fit over the connection jack. The swagging shell is used to firmly hold the terminator cap to the connection jack connector and firmly hold the flared fingers of the connection jack connector to the connection jack. A locking shroud is attached to the connection jack such that the locking shroud surrounds the connection jack, the connection jack connector, the terminator cap and the swagging shell.

3 Claims, 2 Drawing Sheets

COAXIAL CABLE CONNECTION PROTECTION SYSTEM FOR UNUSED CONNECTION PORT

UNITED STATES PATENT APPLICATIONS INCORPORATED BY REFERENCE

This application is a continuation of application Ser. No. 08/118,119 filed Sep. 7, 1993 now U.S. Pat. No. 5,435,736, the disclosure of which is incorporated by reference.

FIELD OF THE INVENTION

This invention relates generally to devices and methods for protecting coaxial cable connection systems from ambient conditions and from unauthorized tampering and, specifically, to devices and methods for protecting an unused coaxial cable connection port from ambient conditions and from unauthorized tampering.

BACKGROUND OF THE INVENTION

In our previously filed patent application, U.S. patent application Ser. No. 08/118,119, now U.S. Pat. No. 5,435,736, we proposed a coaxial cable connection system which is protected from ambient conditions and from unauthorized tampering. In that system, a cable terminus is connected to a connection jack using a unique connection jack connector. The connection jack connector comprises a connection jack attachment moiety having a plurality of fingers shaped to form a collet structure. The cable attachment moiety is squeezed firmly over the connection jack by a swagging shell and the entire assembly is surrounded by a locking shroud.

That prior application, however, did not address the problem of how to protect an unused cable connection jack from ambient conditions and from unauthorized tampering.

SUMMARY OF THE INVENTION

The present invention addresses the problem of protecting an unused cable coaxial cable connection jack from ambient conditions and from unauthorized tampering. The invention is a terminating cap comprising a hollow cylindrical body with an open front end and an enclosed rear end. The body is precisely dimensioned to fit snugly over the coaxial cable jack which is to be protected.

The invention is also a system for using the terminating cap in a system which protects the unused connection jack from ambient conditions and from unauthorized tampering. The system comprises (a) an electrically conductive connection jack connector comprising a connection jack attachment moiety and a second moiety attached to the connection jack attachment moiety, the connection jack attachment moiety having a collet structure with a base and a plurality of flared fingers, wherein the connection jack attachment moiety is attached tightly around the threaded body of the connection jack; (b) a terminator cap disposed over the second moiety of the connection jack connector, the terminator cap comprising a hollow cylindrical body with an open front end and an enclosed rear end; (c) a hollow, open-ended swagging shell comprising a compression moiety and a retraction moiety, the compression moiety being disposed tightly over the flared fingers of the connection jack connector thereby applying hoop stress to the flared fingers so as to urge the flared fingers into tight connection with the threaded body of the connection jack; and (d) a hollow locking shroud having elongated side walls which define a locking shroud chamber with an open end, the locking shroud being disposed with respect to the connection jack in such a way that the side walls surround the connection jack, the connection jack connector, the terminator cap and the swagging shell.

In an alternative embodiment, the system further comprises an electrical resistor electrically connected at one end to the connection jack connector and at the other end to the internal conductor connection opening in the center of the connection jack. In general, it will be preferred that the resistor have a rating of about 75 ohms to match the impedance of the coaxial cable network.

DESCRIPTION OF THE DRAWINGS

These and other features, aspects and advantages of the present invention will become understood with reference to the following description, appended claims and accompanying drawings, where:

DETAILED DESCRIPTION OF THE INVENTION

Figure 1:
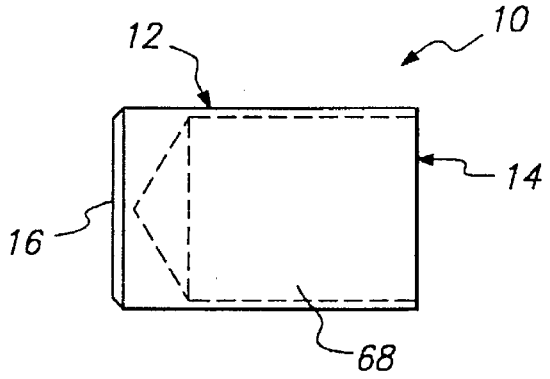
FIG. 1 is a perspective of a terminator cap having features of the invention.

The following discussion describes in detail one embodiment of the invention and several variations on that embodiment. This discussion should not be construed as limiting the invention to that particular embodiment or to those particular variations. Practitioners skilled in the art will recognize numerous other embodiments and variations as well. For a definition of the complete scope of the invention, the reader is directed to the appended claims.

The invention is a terminator cap 10 comprising a hollow cylindrical body 12 with an open front end 14 and an enclosed rear end 16.

The invention is also a system for protecting an unused coaxial cable connection jack 18 comprising a connection jack connector 20, a swagging shell 22, a locking shroud 24 and the terminator cap 10.

In the embodiment shown in the drawings, the connection jack connector 20 is an EZ LOCK connector manufactured by Raychem Corporation of Menlo Park, Calif. Such a connection jack connector 20 has a connection jack attachment moiety 26 and a second moiety 28. The connection jack attachment moiety 26 has a collet structure with a collet base 30 and a plurality of flared fingers 32 which extend outwardly from the base 30 to form a collet attachment cup 34 having a peripheral edge 36.

The fingers 32 define the collet cup 34 and provide an inside cylindrical engagement surface 38 suitable for engaging the outer threaded surface 40 of a connection jack 18. The inside surface 38 of the fingers 32 may be smooth or it may be provided with a shallow-cut ridge (not shown) such as one or more threads. Preferably, each finger 32 has such a ridge running laterally across the width of each finger 32 to correspond with the thread pitch of the jack 18. In embodiments having such a ridge, a more positive attachment can be achieved between the connection jack connector 20 and the connection jack 18.

Preferably, each finger 32 is formed with a thickened region adjacent to the ridge which becomes gradually thinned towards its connection with the collet base 30. The inside geometry of the collet base 30 is generally cylindrical when in an unstressed, uncompressed state, the collet cup 34 defines a slightly curved or frustroconical geometry. This allows the connection jack attachment moiety 26 to be easily slipped over the outside surface 40 of the connection jack 18.

The collet cup 34 is dimensioned so that, in its unstressed state, it can be easily slipped over the outer surface 40 of the connection jack 18 but, when hoop stress is applied to the external surface of the fingers 32, the connection jack attachment moiety 26 can be tightly connected around the connection jack 18.

In a preferred embodiment to be used with a standard F-port connection jack 18 having an outside diameter of 0.374 inches, the collet structure 34 comprises four fingers 32, each defining a quadrant of a cylinder having an inside diameter between about 0.37 and about 0.38 inches. Each finger 32 is between about 0.2 and about 0.5 inches long. Each finger 32 is separated from an adjacent finger 32 by a longitudinal slot 44 which can be between about 0.01 and about 0.1 inches wide, preferably between about 0.04 and about 0.05 inches wide. The fingers 32 may be formed by cross-sawing across the collet structure at right angles. Alternatively, and preferably for mass production, the fingers 32 are formed by a single machining operation of two parallel saws which are moved in one direction across the collet structure 34.

The connection jack 20 connector further comprises a second moiety 28 which is generally adapted to attach to a coaxial cable terminus (not shown). As shown in the drawings, the second moiety 28 of the connection jack connector 20 is a hollow screw mandrel.

The connection jack connector 20 is typically made from an electrically conductive material, such as a metal. Aluminum is a highly preferred metal because of its light weight and because it is inexpensive and highly conductive.

The swagging shell 22 has an open-ended hollow tubular shape. The swagging shell 22 has a compression moiety 48 and a retraction moiety 50. The compression moiety 48 is adapted to apply hoop stress to the exterior of the collet fingers 32 on the connection jack connector 20 and the retraction moiety 50 is adapted to interface with one or more tools adapted to drive the swagging shell 22 over the collet fingers 32 and/or, alternatively, to retract the compression moiety 48 off of, and away from, the collet fingers 32.

The compression moiety 48 is generally cylindrical and is dimensioned to be slidable over the collet fingers 32 in such a way as to impart considerable hoop stress to the collet fingers 32, thereby causing the collet fingers 32 to tightly grip the exterior surface 40 of the connection jack 20. For a standard connection jack 20 having an outside diameter of about 0.374 inches, the inside diameter of the compression moiety 48 is typically between about 0.40 and about 0.42 inches, preferably between about 0.410 and 0.415 inches.

The retraction moiety 50 of the swagging cylinder 12 is also typically cylindrical. It is attached to the compression moiety 48 in such a way that the longitudinal axes of the compression moiety 48 and the retraction moiety 50 are coaxial. The inside diameter of the compression moiety 48 is dimensioned to allow the retraction moiety 50 to slip freely along the outside of the coaxial cable terminus. In a preferred embodiment, the outside diameter of the retraction moiety 50 is dimensioned to be slightly smaller than the outside diameter of the compression moiety 48 so that an annular shoulder 52 is formed at the interface of the retraction moiety 50 and the compression moiety 48. In a typical embodiment, the annular shoulder 52 is between about 0.10 and about 0.20 inches in width. Such annular shoulder 52 provides a surface against which an axial force can be applied so as to urge the swagging shell 22 over the collet fingers 32.

In another preferred embodiment, the exterior surface 52 of the retraction moiety 50 is provided with indentations, ridges or other structure capable of providing a surface against which a force can be applied to the swagging shell 22 to urge the swagging shell 22 off of the collet fingers 32. In a most preferred embodiment, such structure is provided by external screw threads.

The swagging shell 22 is made from a rigid material capable of withstanding the pressures and wear and tear resulting from its interaction with the collet fingers 32 and with various driving and retraction tools. Typically, the swagging shell 22 is made from a metal, such as a brass, an aluminum or a steel.

The locking shroud 24 is disposed over one or more connection jacks 18. The locking shroud 24 is an elongated hollow structure having elongated sidewalls 54 which define a plurality of locking shroud chambers 56. The locking shroud chambers 56 each have an open end 58 to allow for insertion into the chamber 56 of the terminus of a coaxial cable.

Preferably, each locking shroud chamber 56 is connected to one other locking shroud chamber 56 by a flexible web (not shown) disposed in a curved plane. Such web allows the spacing between the locking shroud chambers 56 to be slightly adjusted by flexing the web.

Typically, the flexible web is made of a resilient, semi-rigid material such as a semi-rigid plastic. Other materials can be used as well, so long as the web retains enough flexibility to allow the spacing between the shrouds to be sufficiently adjusted, and so long as the web retains sufficient strength to resist tampering by someone applying a twisting moment.

In the embodiments shown in the drawings, the thickness of the web is relatively uniform. Where the web material is a semi-rigid plastic, such as nylon or polycarbonate, the thickness of the web is typically between about 0.04 inches and about 0.14 inches, preferably between about 0.05 inches and about 0.07 inches. The web need not, however, have a uniform thickness. The web can have a central "thin" portion to give it additional flexibility.

The curvature of the web will also depend on the degree of flexibility required and the material used to form the web. In a typical embodiment where the web is made from a semi-rigid plastic, the curvature of the web can be between about 50 degrees and about 80 degrees, preferably between about 55 degrees and about 73 degrees.

In a typical embodiment, the curvature of the web, the thickness of the web and the material of the web is chosen such that the spacing between the locking shroud chambers 58 can easily be changed by ±20% without special tools and without damaging the web. Preferably, the spacing between the locking shroud chambers can be easily changed by ±25% without special tools and without damaging the web.

Typically, each locking shroud chamber 56 is relatively long and relatively narrow so as to inhibit the ability of an individual to project his or her fingers or an ordinary tool through the open end 58 of the chamber 56 to tamper with the connection between the jack 18 and the connection jack connector 20. In a preferred embodiment, each locking shroud chamber 56 is cylindrical and has a diameter only slightly larger than the outer diameter of the swagging shell 22. The amount of annular space between each locking shroud 24 and the swagging shell 22 can be sufficient to insert a retraction tool (not shown) or it may be less. In a typical embodiment, the difference between the inside diameter of each locking shroud chamber 56 and the outside diameter of the swagging shell 22 is between about 0.005 and about 0.2 inches.

The locking shroud 24 should preferably be constructed of a tough, tamper-resistant material, such as a metal or a strong plastic.

The locking shroud 24 is adapted to be attachable to a plurality of connection jacks 18. In a typical embodiment, the locking shroud 24 has a plurality of transverse end walls 62 each of which define a central aperture 64 dimensioned to accept therethrough a connection jack 18. In such an embodiment, the locking shroud 24 can be secured at the base of the connection jack 18 by a nut 66 threadably attached over the connection jack 18 so as to firmly bind the end wall 62 of the locking shroud 24 with the nut 66.

A locking shroud liner (not shown) can be disposed within each locking shroud chamber 56 to provide additional strength and tamper resistance. For example, in embodiments of the invention wherein the locking shroud 24 is manufactured from a plastic, a metallic locking shroud liner can be disposed within one or more of the locking shroud chambers 56. Each locking shroud liner can be attached within the locking shroud chambers 56 in any number of ways. In one embodiment, each locking shroud liner comprises an end wall having a central aperture dimensioned to slip over the connection jack 18, and a nut is provided to threadably attach over the jack 18 to thereby secure the locking shroud liner at the base of the jack 18. In another embodiment, the locking shroud liner has an end wall with a central aperture which is internally threaded and dimensioned to threadably connect to the connection jack 18. In such an embodiment, it is preferable to provide the locking shroud liner with indentations or ridges capable of engaging a tool or other means of applying a rotational force to the liner so as to be able to rotate the liner off of the jack 18. Preferably, the clearance between any locking shroud liner and the locking shroud chamber 56 is between about 0.005 and about 0.01 inches.

In one embodiment of the invention, the swagging shell 22 is driven onto the collet fingers and the locking shroud chamber 56 is sealed by use of a driver cap (not shown). The driver cap is a small cylindrical section, typically between about 0.2 and about 0.3 inches long, and having external threads and a central aperture. The central aperture is dimensioned to freely slide along the exterior of coaxial cable 46. Typical central aperture inside diameters are between about 0.24 and about 0.41 inches. The driver cap is used with embodiments of the invention having a cylindrical locking shroud liner. The locking shroud liner is provided with internal threads, and the outside diameter of the driving cap is dimensioned to threadably attach to those threads. The surface provided by the annular thickness of the driver cap is dimensioned to cooperate with an opposing surface on the swagging shell 22 so that the driver cap can be used to drive the swagging shell 22 onto the collet fingers 32 by threading the driver cap into the locking shroud 24 (or locking shroud liner). To facilitate rotation of the driver cap, the driver cap can be provided with indentations or ridges which will cooperate with a tool or other force-imparting means for rotating the driver cap.

A dust cover (not shown) can be used to seal the open end 58 of each locking shroud chamber 56 from ambient air. A typical dust cover will be constructed of a light plastic material and be dimensioned to be received, and frictionally retained, within the open end 58 of the locking shroud chamber 56. In embodiments employing a driver cap, a dust cover may be dimensioned to be received and retained within the central aperture of the driver cap.

A locking shroud cover (not shown) can be used to encapsulate the locking shroud 24. A locking shroud cover can be effectively used, for example, to cover the entire area of a tap face. A locking shroud cover provides additional protection against tampering and can also provide an additional sealing function with respect to ambient air.

The terminator cap 10 is dimensioned to accept the second moiety 28 of the connection jack connector 20 within the hollow chamber 68 formed by the walls of the terminator cap 10. The terminator cap 10 is slipped over the second moiety 28 of the connection jack connector 20 via the open front end 14 of the terminator cap 10. The outside diameter of the terminator cap 10 is chosen so that, when the swagging shell 22 is disposed over the terminator cap 10, the terminator cap 10 is press fit within the hollow portion of the retraction moiety 48 and is thereby held firmly within the swagging shell 22. Thus, the terminator cap 10 typically has an external diameter which is between about 1.017% and about 1.003% of the inside diameter of the compression moiety of the swagging shell 22.

The inside diameter of the terminator cap 10 is not critical so long as it is large enough to allow the terminator cap 10 to fit over the second moiety 28 of the connection jack connector 20. In a typical embodiment, the inside diameter of the terminator cap 10 is between about 0.29 and about 0.32 inches.

The length of the terminator cap 10 is not critical so long as it is long enough to be press fit into the compression moiety 48 of the swagging shell 22 during installation and it is short enough not to prevent the compression of the flared fingers 32 of the connection jack attachment moiety 26 of the connection jack connector 20 during installation. When used with a connection jack connector 20 having a connection jack attachment moiety 26 with a length of about 0.25 inches, and a second moiety 28 having a length of about 0.36 inches, the length of the terminator cap 10 is typically be between about 0.45 inches and about 0.475 inches.

The terminator cap 10 be any suitable material which can be easily and inexpensively manufactured. Typically, the terminator cap 10 will be made from a plastic or a metal, such as aluminum or stainless steel.

Where it is desired that the unused connection jack have an impedance consistent with the impedance of the coaxial cable network, an electrical resistor 70 can be disposed within the protective system (described above) in such a way that a first lead 72 of the resistor 70 is electrically connected to the external surface 40 of the connection jack 18 and a second lead 74 is electrically connected to the internal conductor 76 disposed behind the central opening 78 of the connection jack 18. In the embodiment shown in FIG. 5, this is accomplished by sandwiching the first lead 72 of the resistor 70 between the terminator cap 10 and the second moiety 28 of the connection jack connector 20 and thrusting the second lead 74 of the resistor 70 through the central opening 78 of the connection jack 18 to contact the internal conductor 76 within the connection jack 18. Generally, it will be preferred that such an electrical resistor 70 match the impedance of the coaxial cable network. Thus, for a 75 ohm coaxial cable network, the rating of the resistor 70 will be about 75 ohms.

Figure 2:
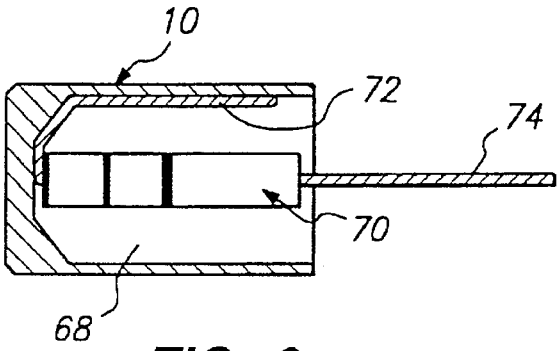
FIG. 2 is a cross-sectional side view of a second terminator cap having features of the invention and including an electrical resistor.
Figure 3:
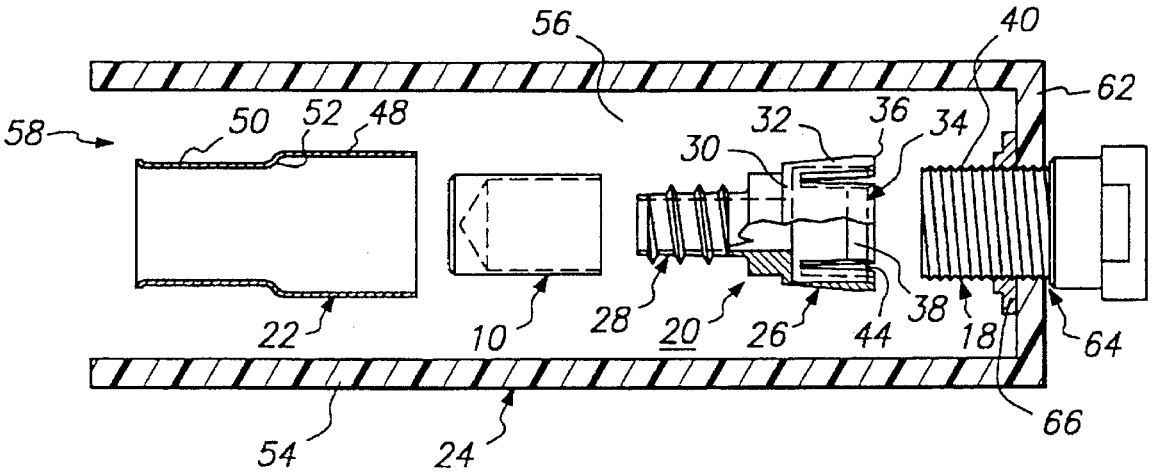
FIG. 3 is an exploded side view in partial cross-section of a protective system having features of the invention.
Figure 5:
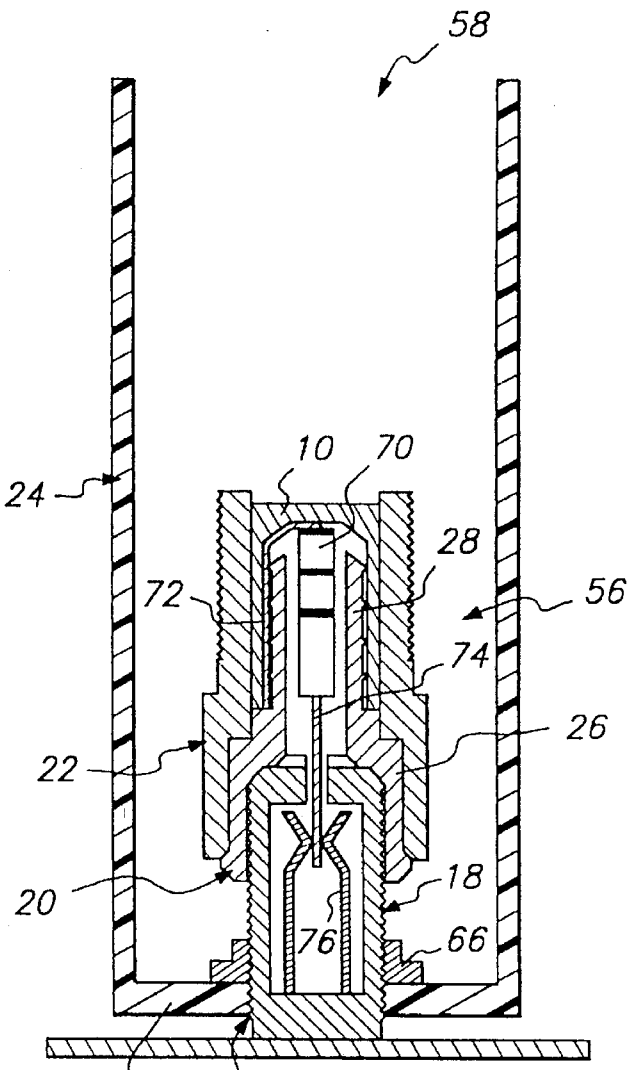
FIG. 5 is a side view in partial cross-section showing a second embodiment of a protective system having features of the invention, which system incorporates an electrical resistor.
Figure 4:
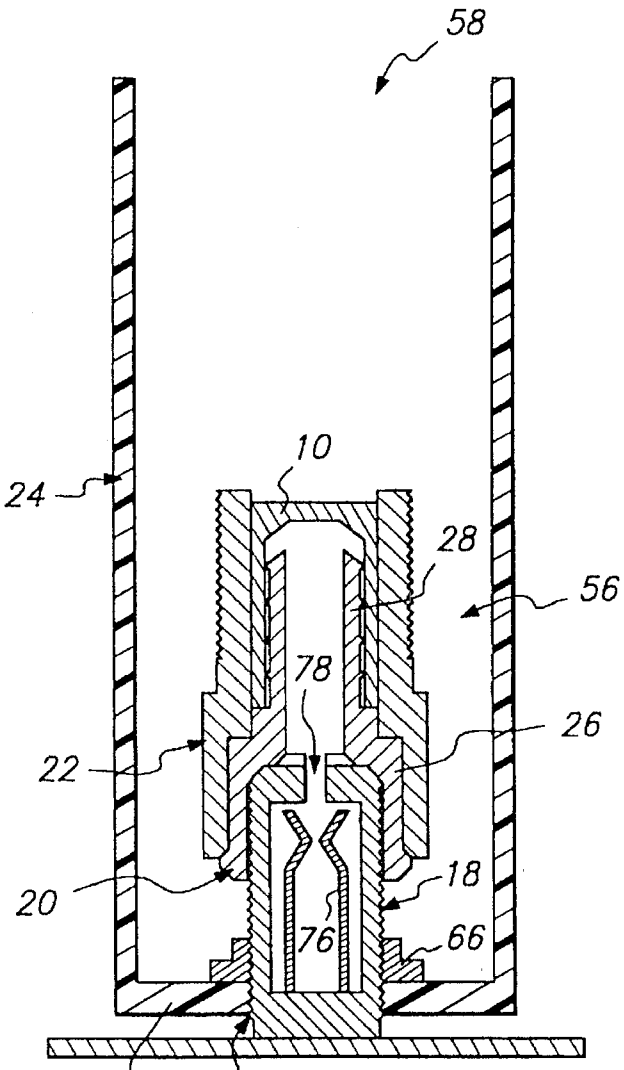
FIG. 4 is a side view in partial cross-section showing the system of FIG. 3 as fully assembled.

To facilitate the installation of a resistor 70 into the system as described above, the resistor 70 can be preinstalled into the terminator cap 10 as shown in FIG. 2. In such an embodiment, the resistor 70 can be attached to the rear end 16 of the terminator cap 10 so that it is disposed concentrically within the hollow chamber 68 formed by the cylindrical walls of the terminator cap body 12. The first lead 72 is disposed in close proximity to the inner surface of the terminator cap 10. The second lead 74 is thrust forwardly along the longitudinal axis of the terminator cap 10 so as to protrude out through the open front end 14 of the terminator cap 10. The length of the second lead 74 of the resistor 70 is chosen so that it can reach the internal conductor 76 within the connection jack 18 when it is installed as shown in FIG. 5.

The foregoing describes in detail several preferred embodiments of the invention. The foregoing should not be construed, however, as limiting the invention to the particular embodiments describes. Practitioners skilled in the art will recognize numerous other embodiments as well. For a definition of the complete scope of the invention, the reader is directed to the appended claims.

What is claimed is:

1. In combination, a swagging shell and a terminating cap for protectively covering a standard coaxial cable F Port connection jack, the cap comprising a hollow cylindrical body with an open front end and an enclosed rear end, the body having an external surface, an internal surface and a longitudinal axis, the outside diameter of the body being between about 0.40 and about 0.42 inches, the inside diameter of the body being between about 0.29 and about 0.32 inches, and the length of the body being between about 0.45 and about 0.475 inches, and the swagging shell comprising an open-ended hollow compression member dimensioned to receive said terminating cap press fit therewithin.

2. The terminating cap of claim 1 further comprising an electrical resistor disposed concentrically within the body, the resistor having a first lead and a second lead with the first lead being disposed parallel to and proximate with the interior surface of the body and with the second lead being disposed forwardly along the longitudinal axis of the body through the open front end.

3. In combination, a swagging shell and a terminating cap for protectively covering a standard coaxial cable F Port connection jack, the cap comprising a hollow cylindrical body with an open front end and an enclosed rear end, the body having an external surface, an internal surface and a longitudinal axis, the terminating cap further comprising an electrical resistor disposed concentrically within the body, the resistor having a first lead and a second lead with the first lead being disposed parallel to and proximate with the interior surface of the body and with the second lead being disposed forwardly along the longitudinal axis of the body through the open front end, and the swagging shell comprising an open-ended hollow compression member dimensioned to receive said terminating cap press fit therewithin.

* * * * *